US006681892B2

(12) United States Patent
Husband

(10) Patent No.: US 6,681,892 B2
(45) Date of Patent: Jan. 27, 2004

(54) LADDER AND ASSOCIATED METHOD FOR SECURING SAME TO OBJECT

(76) Inventor: James D. Husband, 1356 W. 5th Rd., Plymouth, IN (US) 46563

( * ) Notice: Subject to any disclaimer, the term of this patent is extended or adjusted under 35 U.S.C. 154(b) by 113 days.

(21) Appl. No.: 09/994,327

(22) Filed: Nov. 26, 2001

(65) Prior Publication Data

US 2003/0098202 A1 May 29, 2003

(51) Int. Cl.[7] ..... E06C 9/00; E04G 3/00

(52) U.S. Cl. ..... 182/93; 182/187; 182/91

(58) Field of Search ..... 182/93, 187, 188, 182/178.3, 116, 189, 100, 107, 214, 209, 210, 145, 129, 91; 248/210, 238

(56) References Cited

U.S. PATENT DOCUMENTS

| | | | | |
|---|---|---|---|---|
| 3,995,714 A | | 12/1976 | Brookes et al. | |
| 4,263,983 A | | 4/1981 | Norton | |
| 4,462,485 A | * | 7/1984 | Terry et al. | 182/91 X |
| 4,467,890 A | | 8/1984 | McCallum et al. | |
| 4,726,317 A | * | 2/1988 | Ritten et al. | 182/91 X |
| 4,742,888 A | | 5/1988 | Amacker | |
| 4,991,690 A | | 2/1991 | Woller | |
| 5,109,954 A | | 5/1992 | Skyba | |
| 5,277,273 A | | 1/1994 | Grimes | |
| 5,590,738 A | | 1/1997 | Hunt et al. | |
| 5,655,623 A | | 8/1997 | Skyba | |
| 5,711,399 A | | 1/1998 | Wayne-Prejean | |
| 5,727,648 A | | 3/1998 | Jenkins, Jr. | |
| 5,779,001 A | | 7/1998 | Skyba | |
| 5,791,436 A | | 8/1998 | Talley, Sr. | |
| 5,816,362 A | | 10/1998 | Jenkins, Jr. | |
| 6,003,632 A | | 12/1999 | Miller | |
| 6,138,792 A | * | 10/2000 | Morris | 192/93 |
| 6,199,660 B1 | | 3/2001 | Meeks | |
| 6,378,654 B1 | * | 4/2002 | Ziaylek, Jr. et al. | 182/97 |
| 6,520,291 B2 | * | 2/2003 | Andrey | 182/116 |

OTHER PUBLICATIONS

List of tree–climbing ladders (list produced on or before Jul, 31, 2001).
Page from Bass Pro Shops™ catalogue (Page obtained on or before Jul. 31, 2001).
Page from Cabela's catalogue (Page obtained on or before Jul. 31, 2001).

* cited by examiner

*Primary Examiner*—Hugh B. Thompson
(74) *Attorney, Agent, or Firm*—Barnes & Thornburg

(57) ABSTRACT

A ladder for negotiating an object includes a frame and a lever coupled to the frame. The lever is movable relative to the frame in response to an actuating force applied to the lever to move the lever into engagement with the object to secure the ladder to the object. A method for securing a ladder to an object is also disclosed.

27 Claims, 5 Drawing Sheets

LADDER AND ASSOCIATED METHOD FOR SECURING SAME TO OBJECT

The present disclosure relates to ladders. More particularly, the present disclosure relates to ladders that can be coupled to an object for climbing or otherwise negotiating that object.

BACKGROUND AND SUMMARY

Ladders for negotiating objects are known. See, for example, U.S. Pat. Nos. 3,995,714; 4,263,983; 4,467,890; 4,742,888; 4,991,690; 5,109,954; 5,277,273; 5,590,738; 5,655,623; 5,711,399; 5,727,648; 5,779,001; 5,791,436; 5,816,362; 6,003,632; and 6,199,660B1.

According to the present disclosure, a ladder for negotiating an object comprises a frame and a lever pivotally coupled to the frame at a pivot point. The lever is configured to pivot about the pivot point to engage the object when a user steps on the lever.

Illustratively, the lever includes a pivot arm and an engager arm coupled to the pivot arm at the pivot point. The pivot arm causes the engager arm to pivot into engagement with the object when the user steps onto the object. The pivot arm is angled relative to the engager arm. The pivot arm has a first length and the engager arm has a second length. The first length is greater than or equal to the second length to provide mechanical advantage to the lever during operation thereof.

Further according to the disclosure, a method for securing the ladder to the object comprises the steps of stepping on a first portion of a lever and pivoting the lever so as to urge a second portion of the lever into contact with the object in response to the stepping step. Illustratively, the method further includes the step of strapping the ladder to the object prior to the stepping step.

Additional features will become apparent to those skilled in the art upon consideration of the following detailed description of illustrative embodiments exemplifying the best mode as presently perceived.

BRIEF DESCRIPTION OF DRAWINGS

The detailed description particularly refers to the accompanying figures in which.

DETAILED DESCRIPTION OF DRAWINGS

Figure 1:
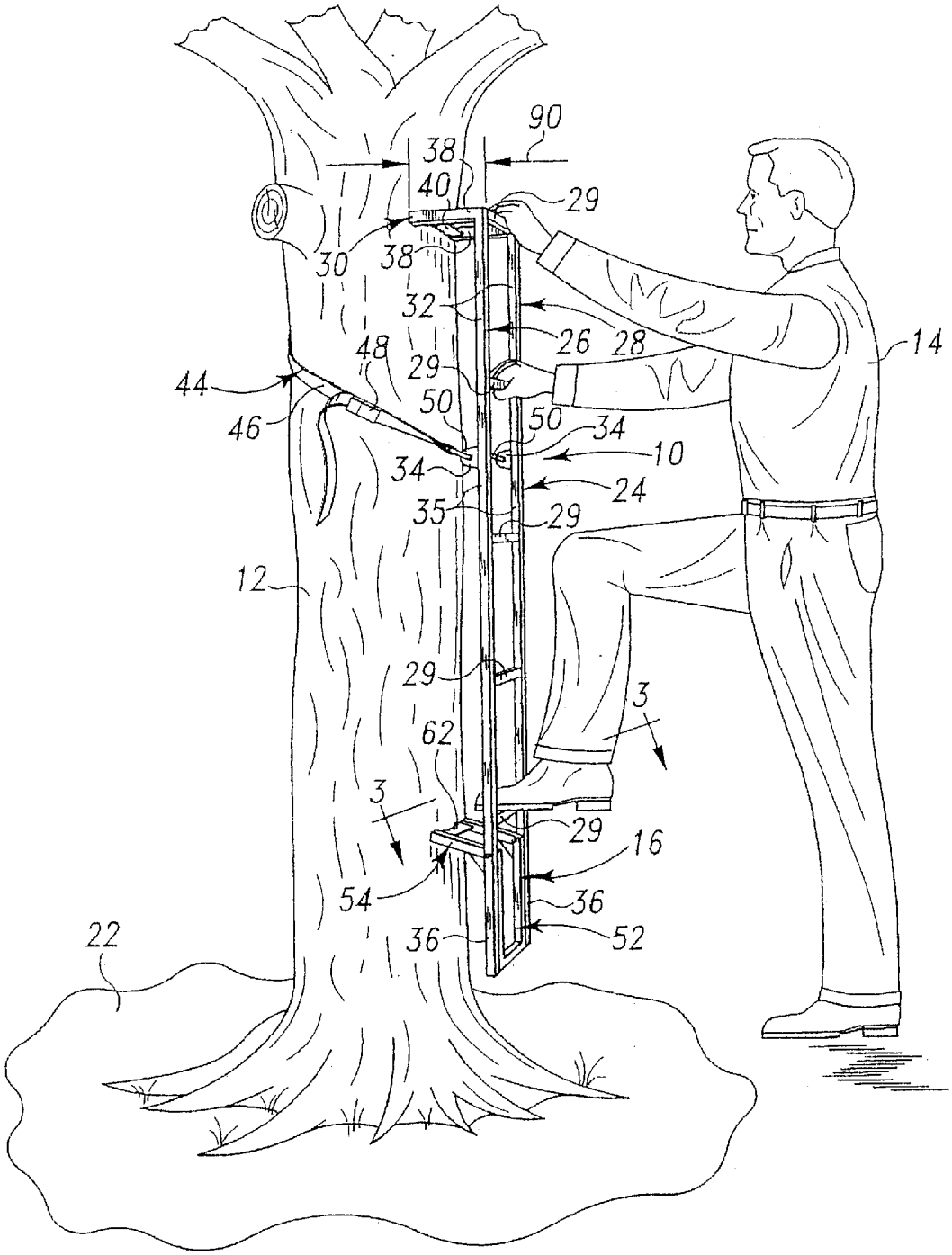
FIG. 1 is a perspective view of a ladder with a lever pivoted into engagement with an object to an engaged position to secure the ladder to the object to make the ladder load-bearing ready.

A ladder 10 is configured to be coupled to an object 12 to allow a user 14 to climb or otherwise negotiate object 12, as illustrated in FIG. 1. Ladder 10 includes a lever 16 configured to pivot about a pivot point or axis 18 from a disengaged position to an engaged position in response to an actuating force 20 applied by user 14 to lever 16 to secure ladder 10 to object 12, as illustrated in FIGS. 1–5. Object 12 is held in place by a foundation 22 and ladder 10 can be secured to object 12 in spaced-apart relation to foundation 22.

In the illustrated embodiment, object 12 is a tree although object 12 can be other objects such as telephone poles, electric power line poles, or other types of vertical objects extending upwardly or downwardly from a foundation. Object 12 may also be an object with a horizontal component.

Foundation 22 can be any suitable foundation for holding object 12 in place. Foundation 22 may be the ground, a concrete slab, or other suitable natural or man-made structure.

Figure 2:
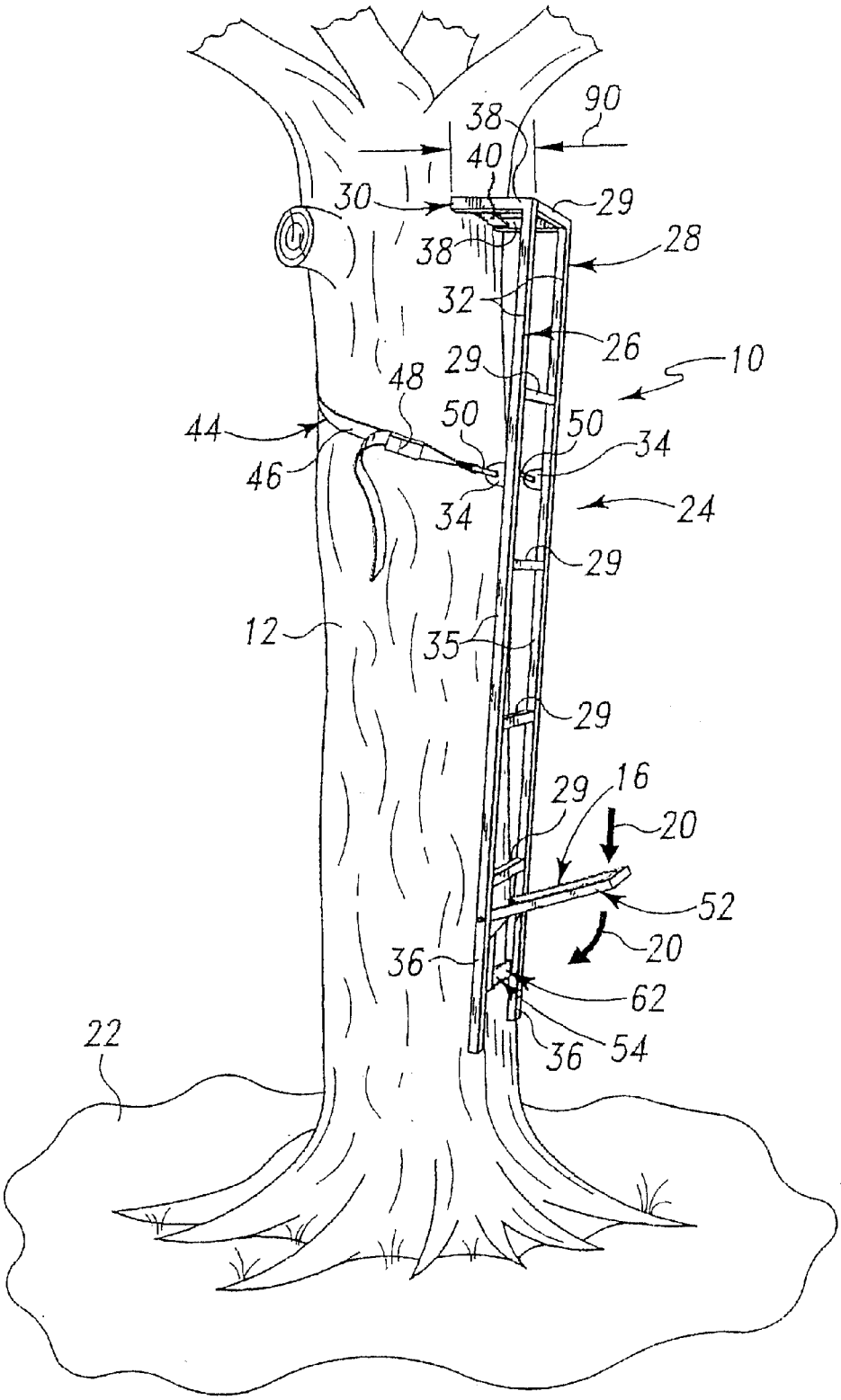
FIG. 2 is a perspective view of the ladder of FIG. 1 showing the lever pivoted out of engagement with the object to a disengaged position.

Ladder 10 further includes a frame 24, as illustrated in FIGS. 1 and 2. Frame 24 supports the moving components of ladder 10. Specifically, as described below in greater detail, the components of frame 24 remain fixed against movement relative to one another, whereas other components of ladder 10 (e.g., lever 16) are movable relative to frame 24.

Frame 24 includes vertical first and second rails 26, 28 and a plurality of steps 29 coupled to rails 26, 28, as illustrated in FIGS. 1 and 2. Alternatively, frame 24 may include only one rail.

Frame 24 further includes a standoff 30 coupled to a top portion 32 of rails 26, 28 and a pair of grommets 34 coupled to an intermediate portion 35 of rails 26, 28 between top portion 32 and a bottom portion 36 of rails 26, 28. Lever 16 is coupled to bottom portion 36 of rails 26, 28. In alternative embodiments, lever 16 can be coupled to other portions of rails 26, 28 such as top portion 32 or intermediate portion 35. In other alternative embodiments, lever 16 can be coupled to other portions of frame 24 such as, for example, one of steps 29 or some type of brace coupled to one or more components of frame 24.

Standoff 30 is configured to position steps 29 away from tree 12 to provide room between ladder and tree 12 for the feet and hands of user 14 as user 14 climbs ladder 10, as illustrated in FIGS. 1 and 2. Standoff 30 is fixed to rails 26, 28 against movement relative thereto. Standoff 30 includes a pair of bars 38. Each bar 38 is coupled to respective rail 26, 28 at one end of bar 38 in generally perpendicular relation thereto. Standoff 30 further includes a plate 40 coupled to an opposite end of each bar 38. Plate 40 includes teeth configured to engage object 12 to secure the top of ladder 10 to object 12.

Ladder 10 further includes a coupler 44 configured to couple ladder 10 to object 12, as illustrated in FIGS. 1 and 2. Coupler 44 is used to space ladder 10 apart from foundation 22. Alternatively, coupler 44 may allow ladder 10 to contact ground 22.

Coupler 44 includes a strap 46, an adjuster 48 for adjusting the effective length of strap 46, and a pair of hooks 50 for coupling strap 46 to grommets 34, as illustrated in FIGS. 1 and 2. Strap 46 is configured to extend around tree 12. Alternatively, coupler 44 may include, for example, a chain or one or more arms configured to couple ladder 10 to object 12 in place of or in addition to strap 46.

Figure 3:
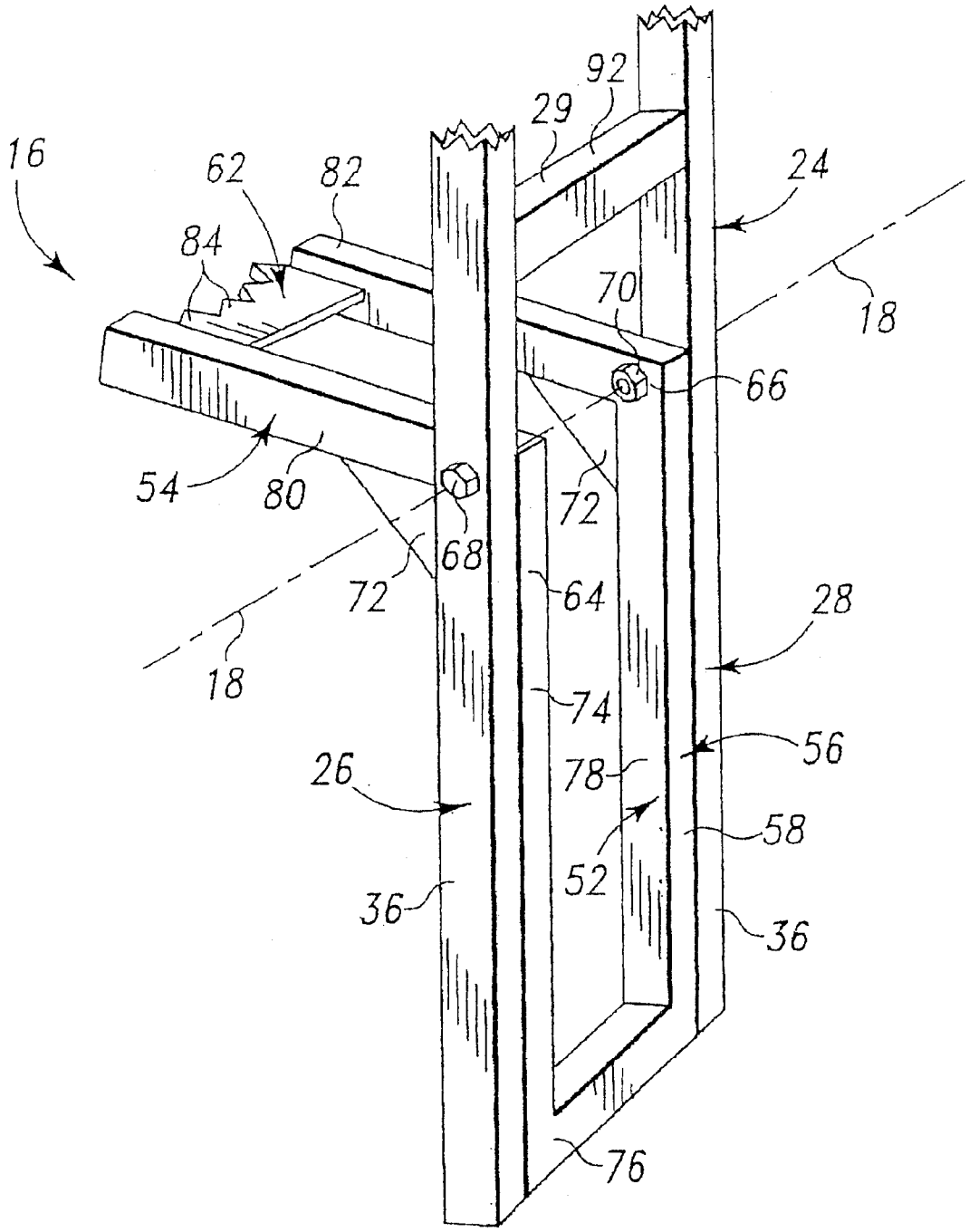
FIG. 3 is a perspective view of the lever of FIG. 1 as viewed in a direction suggested by line 3—3 of FIG. 1 showing the lever in the engaged position.
Figure 4:
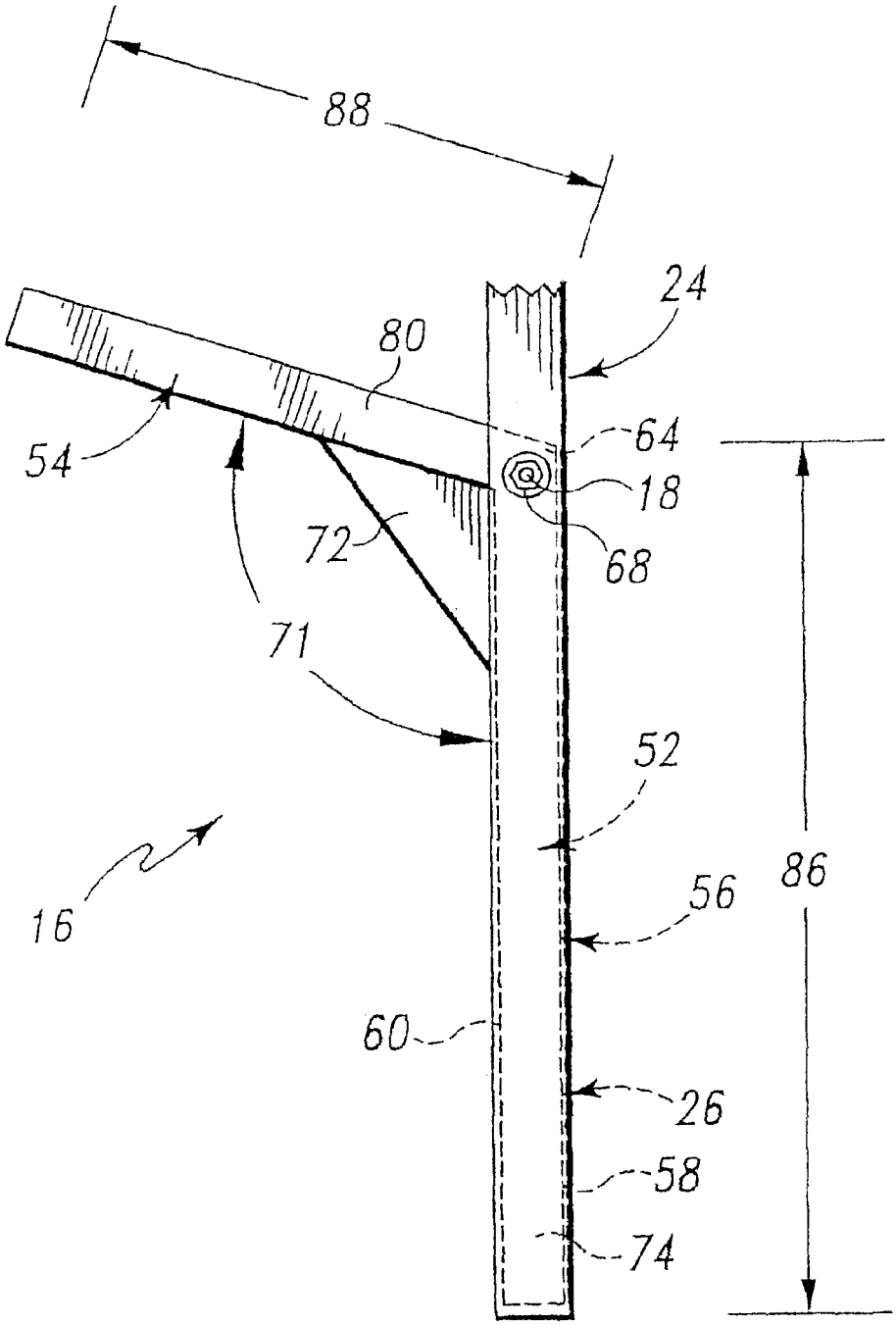
FIG. 4 is a side elevation view of the lever of FIG. 3 showing the lever in the engaged position.
Figure 5:
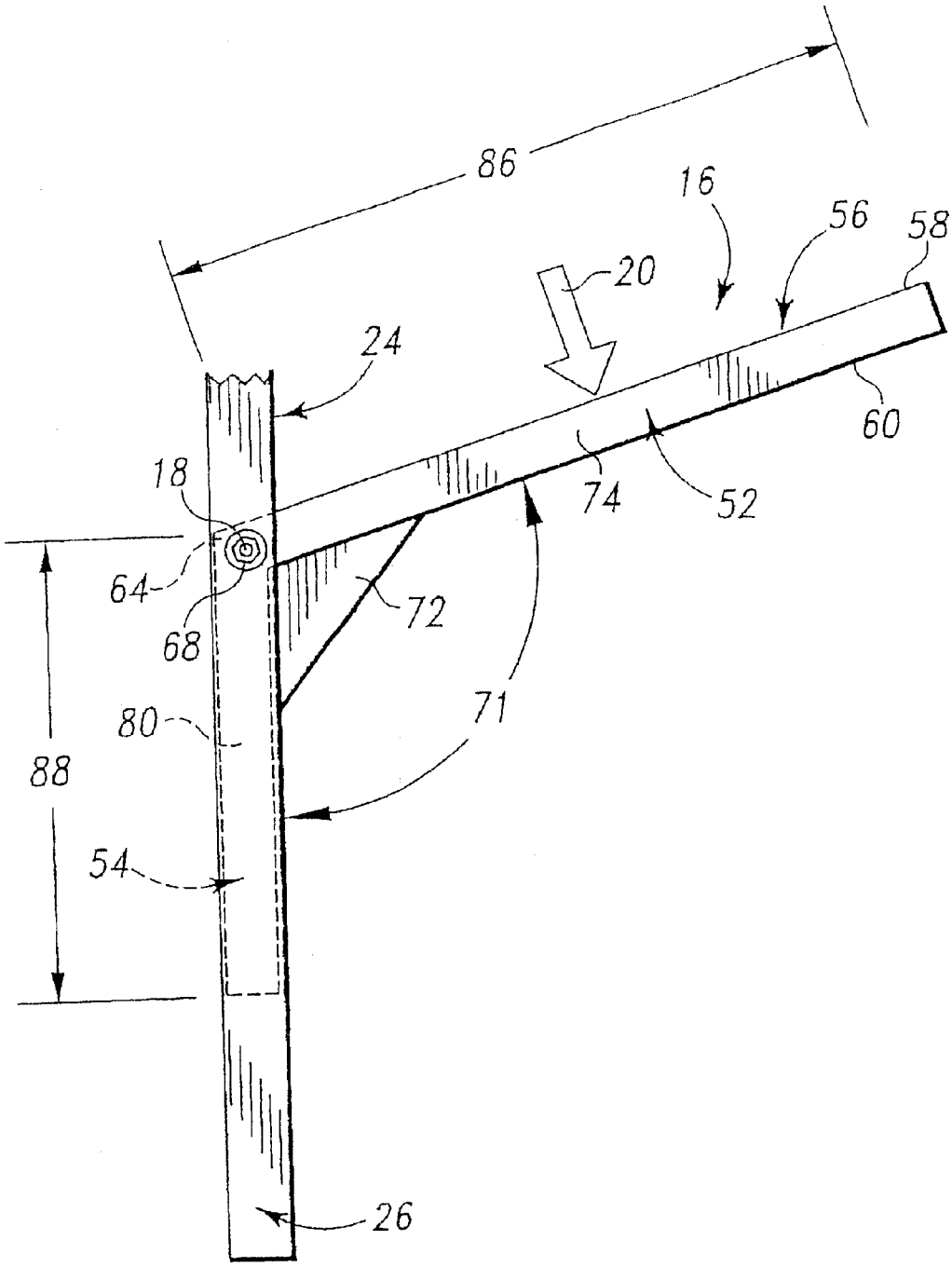
FIG. 5 is a side elevation view of the lever of FIG. 4 showing the lever in the disengaged position.

Lever 16 includes a first portion or pivot arm 52 and a second portion or engager arm 54 coupled to pivot arm 52, as illustrated in FIG. 3. Pivot arm 52 includes an actuation platform 56 including an upper surface 58 and a lower surface 60, as illustrated in FIGS. 4 and 5. Engager arm 54 includes an engager arm member 62 configured to engage tree 12 as illustrated in FIGS. 1–3. Engager arm member 62 pivots into engagement with object 12 in response to application of actuating force 20 to upper surface 58. Engager arm member 62 pivots out of engagement with object 12 in response to application of a force to lower surface 60. Alternatively, lever 16 includes a single bent bar configured to pivot about pivot axis 18 in response to an actuating force applied thereto to pivot into and out of engagement with object 12.

Pivot arm 52 extends away from pivot axis 18 a first length or distance 86 and engager arm 54 extends away from pivot axis 18 a second length or distance 88, as illustrated in FIGS. 4 and 5. First distance 86 is longer than second distance 88 to provide mechanical advantage to lever 16 during operation of lever 16.

Each bar 38 of standoff 30 extends a third length or distance 90 away from respective rail 26, 28. First distance 86 is longer than third distance 90. Alternatively, first distance 86 is equal to or even less than second distance 88 and third distance 90.

Lever 16 is configured to pivot between a disengaged position and an engaged position. In the disengaged position, arms 52, 54 are positioned so that engager arm member 62 is not locked to or otherwise engaged with object 12. For example, arms 52, 54 can be positioned as illustrated in FIGS. 2 and 5. In that arrangement, pivot arm 52 is positioned in a generally perpendicular orientation relative to rails 26, 28 (i.e., pivot arm 52 is positioned in a generally horizontal orientation), whereas engager arm 54 is positioned in a generally downward orientation in a somewhat parallel arrangement relative to rails 26, 28.

In the engaged position, arms 52, 54 are positioned so that engager arm member 62 engages object 12. For example, arms 52, 54 can be positioned as illustrated in FIGS. 1, 3, and 4. In that arrangement, pivot arm 52 is positioned in a direction generally downward (e.g., generally parallel to rails 26, 28) such that the lower end thereof is positioned below a lowermost step 92 of steps 29. Moreover, in such an arrangement, engager arm 54 is positioned in a generally horizontal orientation or even a slightly upwardly arranged orientation.

Arms 52, 54 are secured at an angle relative to one another such that they cooperate to define a first intermediate portion or vertex portion 64 of lever 16 and a second intermediate portion or vertex portion 66 of lever 16, as illustrated in FIG. 3. First vertex portion 64 defines a first vertex and is coupled to bottom portion 36 of first rail 26 via a first fastener 68 extending through apertures in first vertex portion 64 and first rail 26. Similarly, second vertex portion 66 defines a second vertex and is coupled to bottom portion 36 of second rail 28 via a second fastener 70 extending through apertures in second vertex portion 66 and second rail 28. This coupling of vertex portions 64, 66 to rails 26, 28 establishes pivot axis 18. Illustratively, fasteners 68, 70 are nut-and-bolt assemblies although other suitable structures for fastening lever 16 to rails 26, 28 are within the scope of this disclosure.

Arms 52, 54 are angled relative to one another. What is meant herein by the term "angled" is that two components are secured to one another in a manner which defines an angle therebetween which is not 0° or 180°. Arms 52, 54 cooperate to define an angle 71, as illustrated in FIGS. 4 and 5. Angle 71 is sized to provide ready access to actuation platform 56 by a foot of user 14 so that engager arm member 56 can be pivoted from the disengaged position to the engaged position by a downward action of the user's foot. Illustratively, angle 71 is obtuse. Angle 71 can be, for example, 108°. In alternative embodiments, angle 71 may be a right angle or an acute angle.

Lever 16 further includes a pair of reinforcing plates 72, as illustrated in FIGS. 3–5. Each reinforcing plate 72 is coupled to one of vertex portions 64, 66 to reinforce respective vertex portion 64, 66 to sustain the loads applied thereto when engager arm member 62 is pivoted between the disengaged and engaged positions.

Pivot arm 52 includes three bars 74, 76, 78, as illustrated in FIG. 3. Bars 74, 76, 78 are arranged so that pivot arm 52 is U-shaped, for example. Alternatively, pivot arm 52 could include any number of bars, such as only one bar or only two bars, arranged to pivot engager arm 54 in response to an actuating force applied to pivot arm 52.

Engager arm 54 includes two bars 80, 82 that are secured to engager arm member 62, as illustrated in FIG. 3. Alternatively, engager arm 54 could include any number of bars, including only one bar, to support engager arm member 62.

Bars 74 and 80 are coupled to one another. Similarly, bars 76 and 82 are coupled to one another. Bar 78 extends between and is coupled to bars 74 and 76.

Engager arm member 62 is, for example, a plate with teeth 84 configured to bite into object 12, as illustrated in FIG. 3. Engager arm member 62 may take other suitable forms configured to be pivoted into engagement with object 12.

To couple ladder 10 to object 12, user 14 first pivots lever 16 about pivot axis 18 to its disengaged position and couples ladder 10 to object 12. User 14 can apply a force to lower surface 60 to move lever 16 to its disengaged position. Ladder 10 is then coupled to object 12 using coupler 44. One of hooks 50 is coupled to a corresponding grommet 34 and strap 46 is routed around object 12. The other of hooks 50 is then coupled to its corresponding grommet 34 to hang ladder 10 from object 12. In this orientation, bars 38 and teeth of plate 40 of standoff 30 engage object 12 and bottom portion 36 of rails 26, 28 engage object 12, as illustrated in FIG. 2. At this point, strap 46 can be tightened somewhat using adjuster 48 to ensure a rigid connection between ladder 10 and object when lever 16 is pivoted to its engaged position. Before lever 16 is pivoted to its engaged position, strap 46 angles somewhat downwardly and rails 26, 28 are angled relative to object 12.

Lever 16 is then ready to be pivoted to its engaged position to secure ladder 10 to object 12 to make ladder 10 load-bearing ready. User 14 steps on or otherwise applies a downward actuating force 20 to actuation platform 56 using a foot or some other actuator to pivot lever 16. This causes pivot arm 52 to pivot downwardly about pivot axis 18 and engager arm 54 to pivot upwardly about pivot axis 18 until lever 16 is moved to its engaged position. In the engaged position, teeth 84 of engager arm member 62 bite into object 12 so that engager arm member 62 is positioned in engagement with object 12. Ladder 10 may move slightly downwardly causing strap 46 to angle downwardly slightly in response to engagement between engager arm member 62 and object 12. Standoff 30 remains in contact with object 12 during pivoting of lever 16 from the disengaged position to the engaged position. When lever 16 is pivoted to its engaged position, ladder 10 becomes locked to object 12 so that ladder 10 is thereby made load-bearing ready—i.e., ladder 10 is ready to support user 14.

In alternative embodiments, lever 16 can be arranged so that it pivots in the opposite direction in response to an upwardly-directed force to move lever 16 from a disengaged positioned to an engaged position. In other words, pivot arm 52 could pivot upwardly in response to the upwardly-directed force to cause engager arm 54 to pivot downwardly into engagement with object 12.

It should be appreciated that lever 16 can be pivoted by ways other than stepping on lever 16 with a foot. For example, a user may pivot lever 16 by hand or by any other body part. In addition, a user may use some type of mechanical aid to pivot lever 16.

A user may wish to use more than one ladder 10 to scale a tree 12. After climbing a first ladder 10 coupled to tree 12, the user may couple another ladder 12 to tree 12 above the first ladder 10. In coupling the first and second ladders 10 to tree 12, it may be convenient, for example, for the user to pivot lever 16 of the lower ladder 10 by foot and pivot lever 16 of the higher ladder 10 by hand.

What is claimed is:

1. A ladder for negotiating a tree adjacent the ladder the ladder comprising a frame, and a lever pivotally coupled to the frame at a pivot point, the lever including a pivot arm and an engager arm angled relative to one another, and the engager arm coupled to the pivot arm at the pivot point, the lever being pivotable relative to the frame in response to a downward actuating force applied to the pivot arm to cause the engager arm to pivot into engagement with the tree so as to act as a standoff, the pivot arm having a first length, the engager arm having a second length, the first length being greater than or equal to the second length.

2. The ladder of claim 1, wherein the frame includes a rail, and the lever is pivotable relative to the rail.

3. The ladder of claim 2, wherein the frame includes a standoff coupled to the rail, and the standoff has a third length that is less than the first length.

4. The ladder of claim 2, wherein the frame includes a step coupled to the rail, and the lever is coupled to the rail.

5. The ladder of claim 1, wherein the ladder includes a first rail, a second rail, and a step coupled to the first rail and the second rail, and the lever is coupled to the first rail and the second rail.

6. The ladder of claim 1, wherein the frame includes a plurality of steps and a portion of the pivot arm is positioned below a lowermost step of the plurality of steps when the engager arm is positioned to engage the tree.

7. The ladder of claim 1, wherein the engager arm includes a plate with teeth configured to engage the tree and a pair of bars secured to the plate.

8. A ladder for negotiating an object to which the ladder is adjacent, the ladder comprising a frame, and a lever pivotally coupled directly to the frame, the lever including a pivot arm and an engager arm coupled to the pivot arm, the lever being pivotable relative to the frame in response to a downward actuating force being applied to the pivot arm thereby causing the engager arm to pivot into engagement with the adjacent object so as to act as a standoff, the pivot arm and the engager arm being angled relative to one another.

9. The ladder of claim 8, wherein the pivot arm and the engager arm cooperate to define an obtuse angle.

10. The ladder of claim 8, wherein the frame includes a rail coupled to the lever, and the pivot arm is positioned in a substantially parallel orientation relative to a longitudinal axis of the rail when the engager arm is positioned to engage the object.

11. The ladder of claim 8, wherein the pivot arm and the engager arm are fixed against movement relative to one another.

12. The ladder of claim 8, wherein the pivot arm and the engager arm cooperate to define a first vertex portion of the lever, and the first vertex portion is pivotally coupled to the frame.

13. The ladder of claim 12, wherein the frame includes a rail and a step coupled to the rail, and the first vertex portion is pivotally coupled to the rail.

14. The ladder of claim 13, wherein the frame further includes a standoff fixed to the rail against movement relative to the frame, and the lever is positioned below the standoff when the ladder is secured to the object.

15. The ladder of claim 12, wherein the pivot arm and the engager arm cooperate to define a second vertex portion of the lever, and the second vertex portion is pivotally coupled to the frame.

16. The ladder of claim 15, wherein the frame includes a first rail, a second rail, and a step coupled to the first rail and the second rail, the first vertex portion is pivotally coupled to the first rail, and the second vertex portion is pivotally coupled to the second rail.

17. The ladder of claim 8, wherein the frame includes a rail, and the lever is pivotable relative to the rail.

18. A ladder for negotiating an object adjacent the ladder, the ladder comprising a frame, and a lever including a pivot arm and an engager arm coupled to the pivot arm, the lever being pivotally coupled to the frame and located so as to pivot the engager arm into engagement with the object when a user steps on the pivot arm forcing the pivot arm downward so as to enable the engager arm to act as a standoff.

19. The ladder of claim 18, wherein the lever is arranged so that, when a user steps on the pivot arm, the pivot arm moves downwardly and the engager arm moves upwardly.

20. The ladder of claim 18, wherein the frame includes a rail, and the lever is coupled to the rail.

21. The ladder of claim 20, wherein the frame includes a coupler coupled to the rail and configured to be simultaneously coupled to the object.

22. The ladder of claim 20, wherein the ladder includes a step coupled to the rail.

23. A method for securing a ladder to an object, the method comprising the steps of coupling the ladder to the object, stepping on a first portion of a lever coupled to the ladder, and pivoting the lever so as to urge a second portion of the lever into securing contact with the object in response to the stepping step.

24. The method of claim 23, further comprising the step of coupling includes strapping a ladder to the object prior to the stepping step.

25. A method for securing a ladder to an object, the method comprising the steps of coupling a frame of the ladder to the object, providing a lever, the lever including a first portion, a second portion, and an intermediate portion positioned intermediately of the first portion and the second portion and coupled to the frame at a pivot point that is stationary relative to the frame during pivoting of the lever about the pivot point, applying a force to the first portion, pivoting the lever about the pivot point thereby causing the second portion to securingly engage the object in response to the applying step.

26. The method of claim 25, wherein the applying step includes a step of moving the first portion downwardly, and the pivoting step includes a step of moving the second portion upwardly.

27. The method of claim 25, further comprising a step of strapping the ladder to the object prior to the applying step.

* * * * *